US009452762B2

(12) United States Patent
Shimokawa et al.

(10) Patent No.: US 9,452,762 B2
(45) Date of Patent: Sep. 27, 2016

(54) RAILWAY VEHICLE STEERING TRUCK

(75) Inventors: Yoshiyuki Shimokawa, Osaka (JP); Masaaki Mizuno, Osaka (JP); Toshiyo Yamano, Osaka (JP); Tomoki Teramae, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 148 days.

(21) Appl. No.: 14/233,880

(22) PCT Filed: Jul. 17, 2012

(86) PCT No.: PCT/JP2012/068086
§ 371 (c)(1),
(2), (4) Date: Jan. 20, 2014

(87) PCT Pub. No.: WO2013/011978
PCT Pub. Date: Jan. 24, 2013

(65) Prior Publication Data

US 2014/0137764 A1 May 22, 2014

(30) Foreign Application Priority Data

Jul. 21, 2011 (JP) ..... 2011-160276

(51) Int. Cl.
*B61F 5/38* (2006.01)
*B61F 5/44* (2006.01)

(52) U.S. Cl.
CPC .. *B61F 5/38* (2013.01); *B61F 5/44* (2013.01)

(58) Field of Classification Search
CPC ..... B61F 5/38; B61F 5/44; B61F 5/24; B61F 3/04; B61F 3/06; B61F 5/325; B61F 5/30; B61F 5/386; B61F 5/40; B61F 5/42; B61F 5/46; B61F 5/48
USPC ..... 105/168, 165, 218.2, 167
See application file for complete search history.

(56) References Cited

U.S. PATENT DOCUMENTS

| | | | | |
|---|---|---|---|---|
| 2,956,515 | A | 10/1960 | Lich | |
| 4,729,324 | A * | 3/1988 | List | B61D 3/10 105/138 |
| 4,742,779 | A | 5/1988 | Bevand | |
| 2010/0229753 | A1 * | 9/2010 | Kikko | B61F 5/44 105/4.4 |

FOREIGN PATENT DOCUMENTS

| | | |
|---|---|---|
| DE | 195 09 429 | 6/1996 |
| JP | 3536869 | 5/1980 |
| JP | 2-49778 | 4/1990 |
| JP | 6-87446 | 3/1994 |
| JP | 2002-211394 | 7/2002 |

(Continued)

*Primary Examiner* — Mark Le
(74) *Attorney, Agent, or Firm* — Clark & Brody

(57) ABSTRACT

In the event that a steering device is damaged, the damaged component is prevented from dropping onto a surface of a track or prevented from making contact with a surface of a track, even if a component to prevent dropping is not newly installed. A railway vehicle steering truck having a steering device with a steering link which is rotatably connected to an axle box which supports a steering axle, and a connecting link rotatably connected to a bolster, and these are each rotatably connected to a steering lever which is rotatably connected to a truck frame. A length A1 or A2 from one center of rotation of the steering link is shorter than a radius B of a wheel that has reached a wear limit.

14 Claims, 3 Drawing Sheets

(56) References Cited

FOREIGN PATENT DOCUMENTS

| | | |
|---|---|---|
| JP | 2006-282060 | 10/2006 |
| JP | 2009-35201 | 2/2009 |
| WO | 90/02068 | 3/1990 |
| WO | 2009/038068 | 3/2009 |

* cited by examiner

RAILWAY VEHICLE STEERING TRUCK

TECHNICAL FIELD

The present invention relates to a railway vehicle steering truck, and in particular, the present invention relates to a railway vehicle steering truck devised in such a manner that, in the event that a component of a steering device such as a steering link becomes broken, the broken steering link can be prevented from making contact with a surface of a track.

BACKGROUND ART

If a steering device of a railway vehicle steering truck is damaged by some cause or other, it is necessary to prevent the damaged structural component from dropping onto a surface of a track or to prevent it from making contact with a surface of a track.

For example, in FIG. 9 of Patent Reference 1, there is described a truck equipped with an ordinary axle box suspension arranged in parallel with a steering device. Such a truck is able to travel even if the steering device is damaged.

However, in Patent Reference 1, there is no recitation regarding preventing the damaged structural component from falling onto the surface of the track if the steering device is damaged.

In other words, if the steering device of the steering truck became damaged, it was necessary to newly install a component to prevent dropping, so as to prevent the damaged structural component from dropping onto the surface of the track, and to prevent contact with the track.

PRIOR ART REFERENCES

Patent References

Patent Reference 1: Japanese Patent No. 3,536,869

SUMMARY OF THE INVENTION

Problems to be Solved by the Invention

The problem which the present invention aims to solve is that in cases where a steering device of a conventional steering truck became damaged, it was necessary to newly install a component to prevent dropping, in order to prevent the damaged structural component from dropping onto the surface of the track, and to prevent contact with the track.

Means for Solving this Problem

The present invention has as its object to prevent a damaged structural component from dropping onto a surface of a track and to prevent it from making contact with the track, if a steering device becomes damaged, even if a component to prevent dropping is not newly installed.

The railway vehicle steering truck according to the present invention is a railway vehicle steering truck comprising:

- a steering lever which is rotatably connected to a truck;
- a steering link which is rotatably connected to an axle box which supports a steering axle;
- a connecting link rotatably connected to a vehicle body portion; and
- a steering device comprising the steering link and the connecting link rotatably connected to the steering lever, wherein, for example a length from a center of rotation at one end of the steering link to the other end of the steering link is shorter than a radius of a wheel that has reached a wear limit.

In the following description, the length from a center of rotation at one end of the steering link 1*b* to the other end thereof is referred to as "the length of the steering link 1*b*".

In the railway vehicle steering truck according to the present invention, because the length of the steering link, for example, is shorter than the radius of a wheel that has reached a wear limit, there is no need to newly install a component to prevent dropping in the event that the steering link is damaged, and the damaged steering link does not make contact with the surface of the track.

Advantageous Effects of the Invention

According to the present invention, if a steering device becomes damaged, it is possible to prevent a damaged structural component of the steering device from dropping onto a surface of a track, and to prevent it from making contact with the surface of the track, even if a component to prevent the dropping from occurring is not newly installed.

BRIEF DESCRIPTION OF THE DRAWINGS

FIG. 1 (*a*) is a view from a side of the vehicle. FIG. 1 (*b*) is a view from above the vehicle.

PREFERRED EMBODIMENT

The object of the present invention, which is to prevent a damaged structural component from dropping onto a surface of a track and to prevent it from making contact with the track in the event that the steering device is damaged, even if a component to prevent the dropping from occurring is not newly installed, is achieved by causing the length of the steering link to be shorter than the radius of a wheel that has reached a wear limit, for example.

Example

Figure 1A:
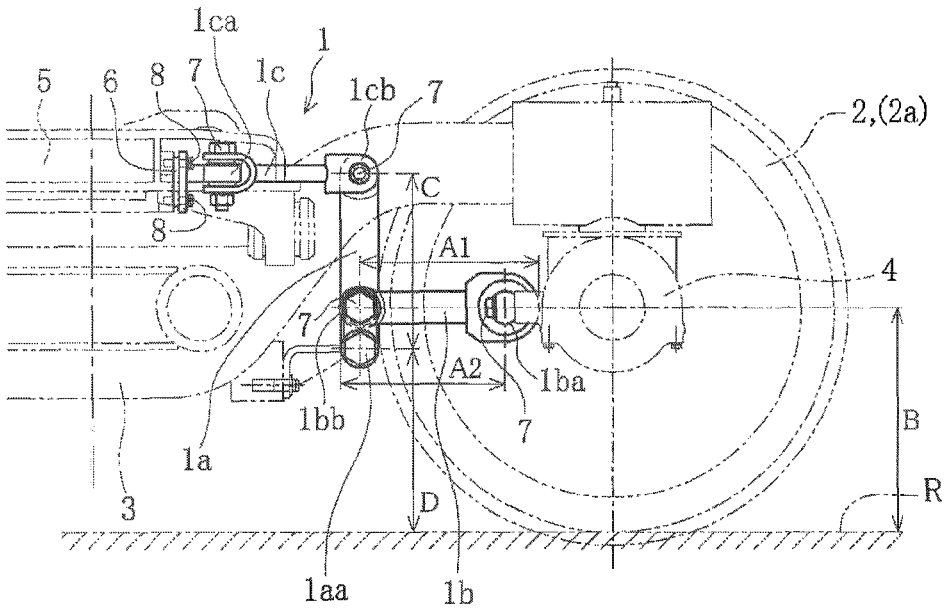
FIG. 1 is an enlarged view of the main components illustrating an example of the steering truck according to the present invention.
Figure 1B:
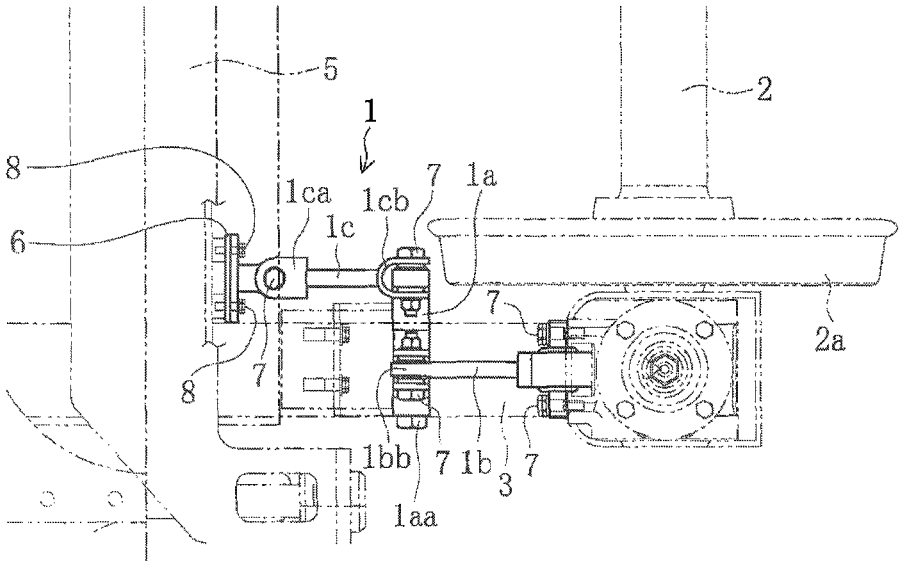
Figure 2:
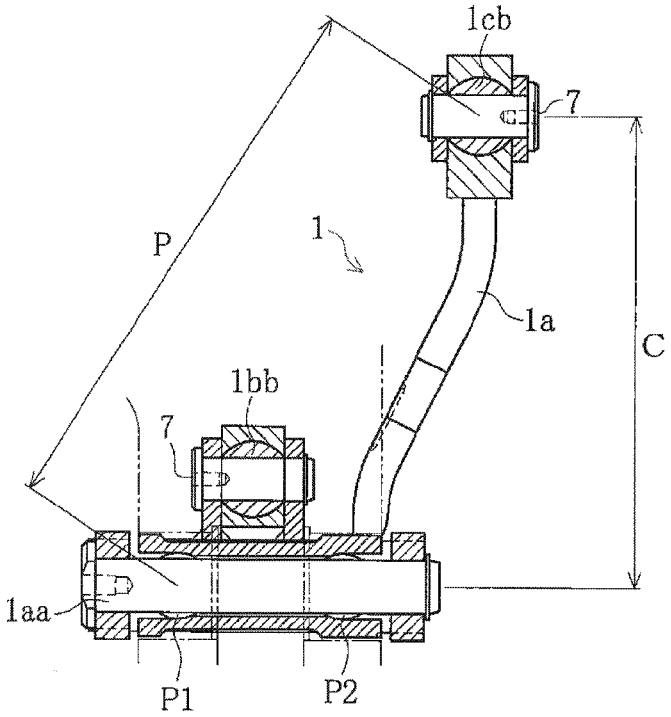
FIG. 2 is a drawing showing a sectional view of a member for attaching a steering lever of a steering device of the steering truck of the present invention to the truck frame.
Figure 3:
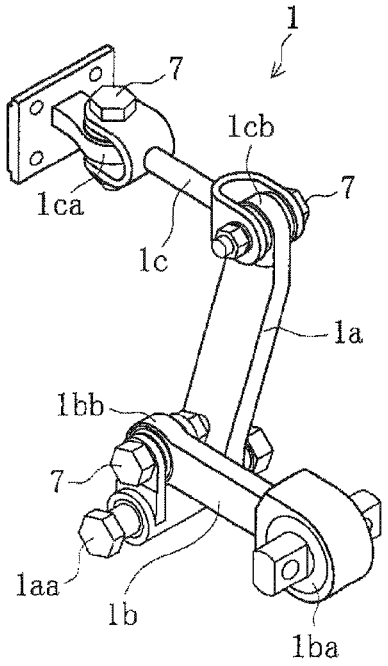
FIG. 3 is a perspective view of a steering device of the steering truck of the present invention.

An example of the present invention is described below, using FIGS. 1-3. In FIGS. 1-3, Reference Numeral 1 is a steering device which steers a wheel axle 2. The steering device has a steering lever 1*a*, a steering link 1*b*, and a connecting link 1*c*. The wheel axle 2 which performs steering is referred to below as a steering axle 2.

The steering lever 1*a* is rotatably connected to a truck frame 3. On the other hand, the steering link 1*b* is rotatably connected to an axle box 4 which supports the steering axle 2 via a spherical plane bush 1*ba*, and the connecting link 1*c* is rotatably connected via a spherical plane bush 1*ca* to a bolster 5 which performs a yawing movement which corresponds to the vehicle body, for example. Moreover, the steering link 1*b* and the connecting link 1*c* are rotatably connected to the steering lever 1*a* via spherical plane bushes 1*bb*, 1*cb*, respectively.

A characteristic feature of the steering truck of the present invention is that a length A1 or A2 of the steering link 1*b* of the steering device 1 configured as described above is shorter than a radius B of a wheel 2*a* that has reached a wear limit.

If such a configuration is employed, the railway vehicle's travel is not impeded, even in the event that the steering link 1*b* of the steering device 1 is damaged by some cause or other, because the damaged steering link 1*b* does not make contact with a track surface R.

Figure 4:
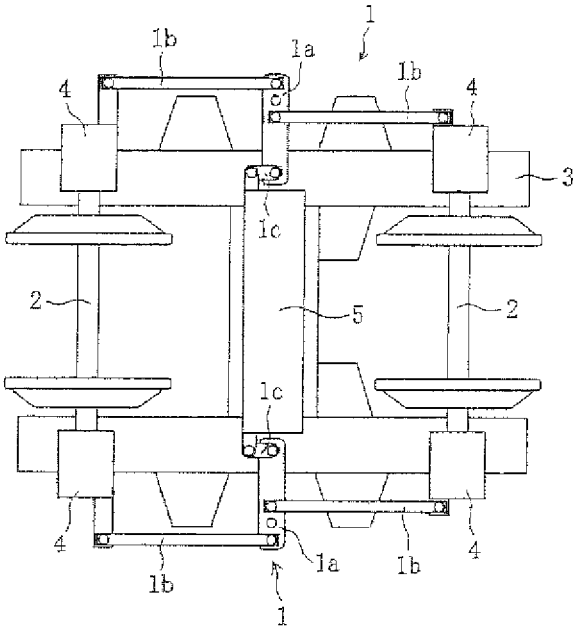
FIG. 4 is a schematic structural diagram of a truck in which is installed a steering device which steers two wheel axles with a single steering lever.

If two wheel axles are supported in a single truck, the supporting interval between the wheel axles must be made greater than twice the radius of a new wheel which has not become worn, so as to prevent interference. When the steering device 1, which steers the two steering axles 2 with a single steering lever 1*a*, such as shown in FIG. 4, is installed in such a truck, the length of the steering link 1*b* necessarily becomes greater than the radius of a wheel when it becomes worn.

Therefore, if the length A1 or A2 of the steering link 1*b* is shorter than the radius B of the wheel 2*a* which has reached a wear limit, as in the invention described above, then the steering lever 1*a* may be attached in a position which is offset from the center of the truck frame 3, towards the side of the axle box 4, as shown in FIG. 1.

In addition, the steering device 1 employs the multiple spherical plane bushes 1*ba*, 1*bb*, 1*ca*, and 1*cb* mentioned above, to allow for a geometric movement between the truck frame 3 and the steering axle 2. However, according to the present invention, the steering lever 1*a* is rotatably supported in the truck frame 3 by a pin 1*aa* which supports it at two coaxial points P1, P2. Accordingly, even in the event that either of the sites of the steering device 1 is broken, the movement of the steering lever 1*a* is maintained in a state in which it freely rotates only with respect to the truck frame 3, thus making it possible to prevent an excessive movement of the steering lever 1*a* when the steering device 1 is damaged. In other words, the excessive movement can be prevented because a distance C is shorter than a distance P shown in FIG. 2.

At this time, the pin 1*aa* which rotatably supports the steering lever 1*a* in the truck frame 3 is set in a perpendicular positional relationship with respect to the track when viewed from above the vehicle, or when the truck is viewed from a lateral plane in the direction of travel.

For example, a vertically oriented length C of the steering lever 1*a* which is supported by the pin 1*aa* in the truck frame 3 may be shorter than a vertical height D from the position where the steering lever 1*a* is supported by the pin 1*aa* up to the surface of the track R when the wheel 2*a* has reached a wear limit. Therefore, in the event that the steering device 1 becomes damaged, the steering lever 1*a* can be prevented from making contact with a surface of the track R. This design has an advantage that machining becomes easy, because motion with respect to the truck can be limited to a perpendicular direction, even if the steering lever 1*a* is disposed diagonally.

On the other hand, if the vertically oriented length C of the steering lever 1*a* is longer than the vertical height D from the position where the steering lever 1*a* is supported by the pin 1*aa* up to the surface of the track R when the wheel 2*a* which has reached a wear limit, then the following design may be implemented.

In the case just described, the connecting side for the connecting link 1*c* with respect to the connecting side for the steering link 1*b* of the steering lever 1*a* is caused to be offset on the central side in the width-wise direction of the vehicle, as shown in FIG. 1 (*b*) and FIG. 2, for example.

Accordingly, when passing through a minimum curve, outside of a range in which the steering lever 1*a* moves with the pins 1*aa*, 1*ab* at the center, the steering lever 1*a* makes contact with the wheel 2*a* or the truck frame 3, before it can make contact with the surface of the track R, so it does not make contact with the surface of the track R.

In the present invention described above, the wheelbase of the steering truck can be adjusted by installing a liner 6 at the truck frame 3 and a connecting member of the steering lever 1*a*, for example, as shown in FIG. 1.

If the liner 6 is attached by a bolt 8 which independently holds only the liner 6, separately from a bolt 7 which is used for transferring a load of the steering device 1, the liner 6 can be prevented from dropping onto the surface of the track R, even if the steering device 1 is damaged, because the liner 6 is held on the truck side, for example.

The present invention is not limited to the above-described example, and the preferred embodiment may, of course, be advantageously modified within the scope of the technical ideas recited in the claims.

For example, in the above example of the present invention, the length A1 or A2 of the steering link 1*b* is shorter than the radius B of a wheel that has reached a wear limit, and the steering lever 1*a* of the steering device 1 is rotatably supported in the truck frame 3 by supporting pins at two coaxial points. However, the steering device 1 does not have to be configured in such a manner that the length A1 or A2 of the steering link 1*b* is shorter than the radius B of a wheel that has reached a wear limit.

Moreover, in the above example of the present invention, the liner 6 was installed in the connecting member of the truck frame 3 and the steering lever 1*a*, but the liner 6 may be installed either at the connecting member of the axle box 4 and the steering link 1*b*, or at the connecting member of the bolster 5 and the connecting link 1*c*. Alternatively, the liner 6 may be installed in both of these locations.

The steering system used in the steering truck of the present invention can be either an active forced steering system or a semi-forced steering system. An active forced steering system employs an air pressure-type, hydraulic-type, or electric-type actuator to supply energy from outside of the system to actively steer a wheel axle while controlling it. A semi-forced steering system employs a mechanical mechanism such as a link to couple the vehicle body, the truck, and the wheel axles, and employs bogie displacement which occurs between the vehicle body and the truck as a driving force while passing through a curve.

EXPLANATION OF THE REFERENCE NUMERALS

1 Steering device
1*a* Steering lever
1*aa* Pin
1*b* Steering link
1*c* Connecting link
2 Steering axle
3 Truck frame
4 Axle box
5 Bolster
6 Liner
7 Bolt which is used for transferring load of the steering device
8 Bolt which independently holds only the liner

The invention claimed is:

1. A railway vehicle steering truck comprising:

a steering lever which is located on an inner side of a truck sideframe and rotatably connected to the truck substantially vertically to a railway line surface when seen from a side of the railway vehicle;

a steering link which is parallel to the truck sideframe, located directly below a bottom surface of the truck sideframe, and rotatably connected to an axle box which supports a steering axle;

a connecting link rotatably connected to a vehicle body portion; and a steering device comprising the steering link and the connecting link rotatably connected to the steering lever, wherein a length from a center of rotation at one end of the steering link to the other end of the steering link is shorter than a radius of a wheel that has reached a wear limit.

2. The railway vehicle steering truck according to claim 1, wherein the steering lever is rotatably connected to the truck in a position which is offset from the center of the truck sideframe towards the axle box.

3. A railway vehicle steering truck comprising:

a steering lever which is located on an inner side of a truck sideframe and rotatably connected to the truck substantially vertically to a railway line surface when seen from a side of the railway vehicle;

a steering link which is parallel to the truck sideframe, located directly below a bottom surface of the truck sideframe, and rotatably connected to an axle box which supports a steering axle;

a connecting link rotatably connected to a vehicle body portion; and a steering device comprising the steering link and the connecting link rotatably connected to the steering lever, wherein the steering lever is rotatably supported in the truck sideframe by a supporting pin at two coaxial points.

4. The railway vehicle steering truck according to claim 1, wherein the steering lever is rotatably supported in the truck sideframe by a supporting pin at two coaxial points.

5. The railway vehicle steering truck according to claim 3, wherein the pin which rotatably supports the steering lever in the truck sideframe is set in a perpendicular positional relationship with respect to the track when viewed from above the vehicle.

6. The railway vehicle steering truck according to claim 4, wherein the pin which rotatably supports the steering lever in the truck sideframe is set in a perpendicular positional relationship with respect to the track when viewed from above the vehicle.

7. The railway vehicle steering truck according to claim 5, wherein a vertically oriented length of the steering lever which is rotatably supported in the truck sideframe is made shorter than a vertical height from the position where the steering lever is rotatably supported by the pin up to the surface of the track when the wheel has reached the wear limit.

8. The railway vehicle steering truck according to claim 5, wherein when a vertically oriented length of the steering lever which is rotatably supported in the truck sideframe by the pin is made longer than a vertical height from the position where the steering lever is rotatably supported by the pins up to the surface of the track when a wheel has reached the wear limit, a connecting side for the connecting link with respect to the connecting side for the steering link of the steering lever is caused to be offset in the width-wise direction of the vehicle, so that, when passing through a minimum curve, outside of a range in which the steering lever moves with the pin at a center, the steering lever makes contact with the wheel or the truck sideframe, before it can make contact with the surface of the track.

9. The railway vehicle steering truck according to claim 1, wherein a liner for adjusting a wheelbase of the steering truck is installed in at least one site including a connecting member of the axle box and the steering link, or a connecting member of a vehicle body and the connecting link, or a connecting member of the truck and the steering lever.

10. The railway vehicle steering truck according to claim 4, wherein a liner for adjusting a wheelbase of the steering truck is installed in at least one site including a connecting member of the axle box and the steering link, or a connecting member of a vehicle body and the connecting link, or a connecting member of the truck and the steering lever.

11. The railway vehicle steering truck according to claim 7, wherein a liner for adjusting a wheelbase of the steering truck is installed in at least one site including a connecting member of the axle box and the steering link, or a connecting member of a vehicle body and the connecting link, or a connecting member of the truck and the steering lever.

12. The railway vehicle steering truck according to claim 8, wherein a liner for adjusting a wheelbase of the steering truck is installed in at least one site including a connecting member of the axle box and the steering link, or a connecting member of a vehicle body and the connecting link, or a connecting member of the truck and the steering lever.

13. The railway vehicle steering truck according to claim 9, wherein the liner for adjusting the wheelbase of the steering truck is attached by a bolt which holds the liner, separately from another bolt which is used for transferring a load of the steering device, the another bolt connecting the connecting member of the axle box and the steering link, the connecting member of the vehicle body and the connecting link, and the connecting member of the truck and the steering lever.

14. The railway vehicle steering truck according to claim 10, wherein the liner for adjusting the wheelbase of the steering truck is attached by a bolt which holds the liner, separately from another bolt which is used for transferring a load of the steering device, the another bolt connecting the connecting member of the axle box and the steering link, the connecting member of the vehicle body and the connecting link, and the connecting member of the truck and the steering lever.

* * * * *